United States Patent [19]

Widman

[11] Patent Number: 4,974,842

[45] Date of Patent: Dec. 4, 1990

[54] DISC HOLDER

[76] Inventor: Bruno Widman, 1833 Root St., Crest Hill, Ill. 60435

[21] Appl. No.: 430,425

[22] Filed: Nov. 2, 1989

[51] Int. Cl.[5] ..... A63B 57/00; G09F 3/18

[52] U.S. Cl. ..... 273/32 A; 273/32 B; 206/0.81; 206/0.82; 40/323; 15/105; 15/236.08

[58] Field of Search ..... 273/32 A, 162 D, 32 B; 40/323, 644, 649, 659; 206/0.8, 0.81, 0.82, 0.83, 0.84

[56] References Cited

U.S. PATENT DOCUMENTS

| | | | |
|---|---|---|---|
| 736,080 | 8/1903 | Fish | 206/0.82 |
| 1,083,149 | 12/1913 | Stearns | 206/0.81 |
| 2,490,482 | 12/1949 | Shackell | 206/0.82 |
| 2,976,629 | 3/1961 | Brixius et al. | 40/659 |
| 3,977,674 | 8/1976 | Zeller | 273/32 A |
| 4,535,987 | 8/1985 | Dikoff | 273/32 A |

*Primary Examiner*—George J. Marlo
*Attorney, Agent, or Firm*—Augustus G. Douvas

[57] ABSTRACT

A pocket-size coin holder in which the coin is principally used as a golf ball marker. The holder has a relatively small metallic body punched from sheet metal. A shallow coin-retaining cup is stamp-formed at a central portion of the body. A coin-retaining bridging pin, which is capable of flexing laterally, extends across the mouth of the cup so as to bisect the area defined by the mouth. The opposite ends of the pin are firmly anchored to the body. The cup is preferably sized to receive a dime coin which is manually inserted into the cup beneath the coin-retaining pin.

9 Claims, 1 Drawing Sheet

DISC HOLDER

BACKGROUND OF THE INVENTION

This invention relates to a disc holder, and in particular to a pocket sized, manipulatable body that can retain a coin which, for example, can be used as a golf ball marker.

The prior art is prolific in devices which contain or support various types of circular elements which may be used as golf-ball markers. To the extent that the present inventor is aware, all of these prior art devices employ custom disc-like elements as markers. Accordingly, if the element is lost, the device is worthless unless a replacement custom marker can be obtained. Even in this circumstance, the time and effort involved in obtaining a replacement marker, worth pennies, for use with a holder costing a dollar or so is uneconomic.

SUMMARY OF THE INVENTION

Accordingly, a principal object of this invention is to eliminate the use of custom golf-ball markers in devices for holding such markers.

Another principal object is to provide a holder for a marker which will retain a coin.

Another object is to provide a pocket-sized coin holder which is durable and easy to fabricate.

A preferred embodiment of this invention comprises a relatively small metallic body punched from sheet metal. A shallow coin-retaining cup is stamp formed at a central portion of the body. A bridging pin which is capable of flexing laterally extends across the mouth of the cup so as to bisect the area defined by the mouth. The opposite ends of the pin are firmly anchored to the body.

In a preferred embodiment, the cup is sized to receive a dime coin. Accordingly, the holder is "loaded" by simply slipping a dime into the cup beneath the bridging pin. In so doing the pin is flexed outwardly slightly. The coin seats itself on the bottom of the cup, and is held in place by the bridging pin pressing slightly against the coin.

The coin is removed by simply pushing or lifting the coin out of the cup against a slight opposing force exerted by the bridging pin.

Quite obviously, in the event the original coin is lost, a replacement coin is universally available. The coin holder of this invention could be sized to receive a coin of any size.

DESCRIPTION OF THE DRAWINGS

In order that all of the structural features for attaining the objects of this invention may be understood, reference is made to accompanying drawings in which.

DETAILED DESCRIPTION OF THE PREFERRED EMBODIMENT

Figure 1:
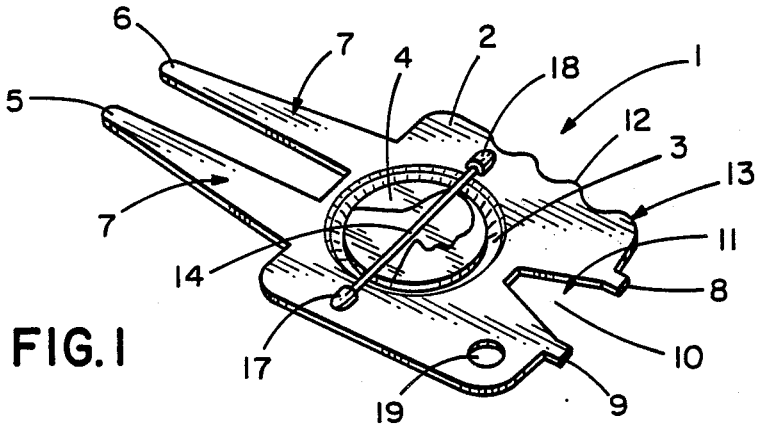
FIG. 1 is a perspective view of the disc holder of this invention "loaded" with a coin.
Figure 2:
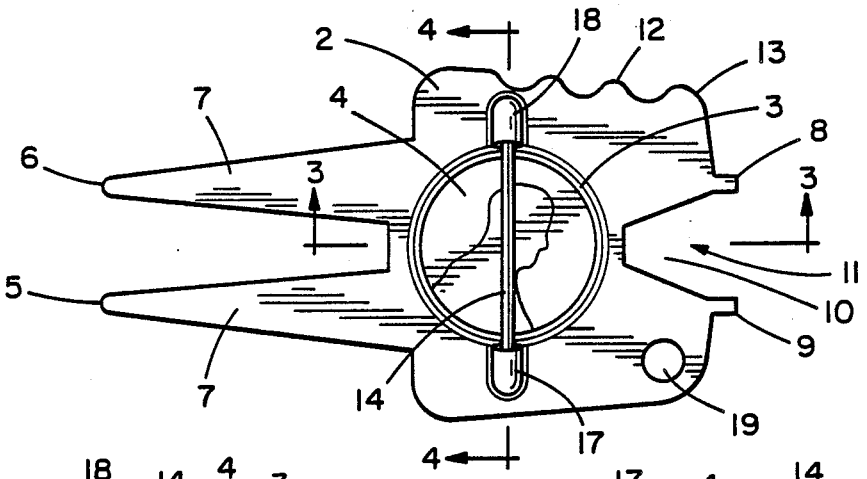
FIG. 2 is a plan view of the disc holder of FIG. 1.
Figure 3:
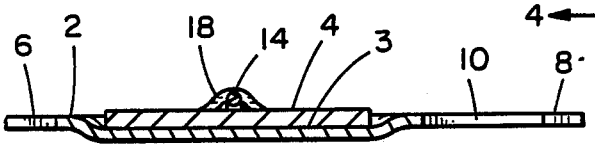
FIG. 3 is a section view taken along line 3—3 of FIG. 2.

Referring to the drawings, a preferred embodiment of disc holder 1 of this invention comprises a relatively small metallic body 2 fabricated from plated sheet metal. A shallow disc-retaining cup 3 is stamp-formed at a central portion of the body.

The diameter of the disc-receiving mouth of cup 3 is slightly ovesized when compared to the size of coin 4 shown in the drawings.

Because of the ready availability of coins, cup 3 is advantageously sized to receive a coin. If body 2 is shaped to form tools useful to a golfer, cup 3 may be sized to receive a dime, which is a convenient size for use as a golf-ball marker. The particular tools integrally formed on the periphery of body 2 are entirely optional and are determined by the principal intended use of disc holder 1. For golfers, body 2 may, for example, be formed with a pair of fingers 5 and 6 which form a turf-lifting fork 7, a pair of small projections 8 and 9 which straddle notch 10 to form a wrench 11 to tighten or remove golf-shoe cleats, and a serrated or rippled edge 12 which forms a scraper 13 for removing mud or turf from the sole of a golf shoe.

It is noted that the prior art discloses many holders for golf-ball markers which are embellished with tool configurations which correspond to turf-lifting fork 7, wrench 11 and scraper 13. The incorporation of these tools form no part of this invention.

This invention is directed to the particular concept and structure for retaining and removing a thin disc, such as a coin, from a body containing a retaining cup.

Figure 8:
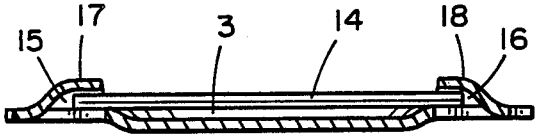
FIG. 8 is a section view taken along line 8—8 of FIG. 7.
Figure 7:
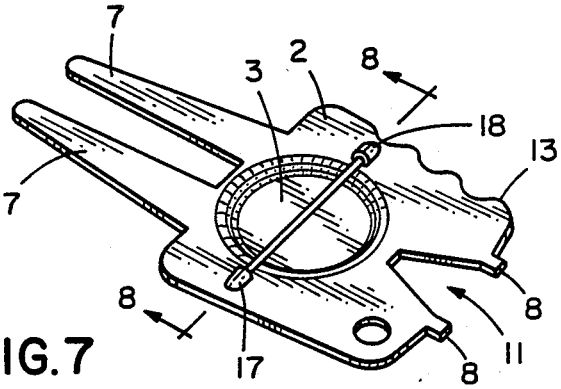
FIG. 7 is a perspective view corresponding to that of FIG. 1, but showing an unloaded cup.

A disc-retaining metallic bridging pin 14 extends across the mouth of cup 3 so as preferably to bisect the area defined by the mouth. Pin 14 will, however, still function to retain coin 4 even of displaced somewhat to either side of its bisecting position shown in the drawings. Bridging pin 14 may be formed from an ordinary pin whose head has been removed. Such a pin is capable of flexing laterally when its opposite ends are confined within the bores 15 and 16 (FIG. 8) of loop anchors 17 and 18 located on the opposite sides of cup 3. Loop anchors 17 and 18 are stamp-formed loops integral to body 4.

Bridging pin 4 is sized lengthwise so that it may be inserted into anchors 17 and 18 by manual flexing of the pin.

Figure 4:
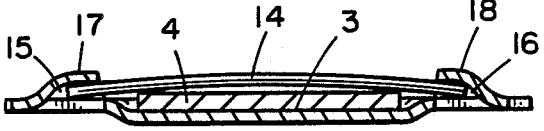
FIG. 4 is a section view taken along line 4—4 of FIG. 2.

When coin pin 4 is seated within cup 3, it assumes the position shown in FIGS. 1, 2, 3 and 4. As is best shown in FIG. 4, coin 4 causes an upward flexing of pin 4, and this flexing action exerts a restraining and locking force upon the coin.

Figure 5:
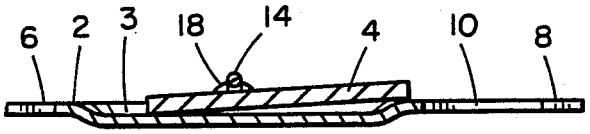
FIG. 5 and 6 are a sequence of views which show the insertion and removal of a coin into the cup of the disc holder.
Figure 6:
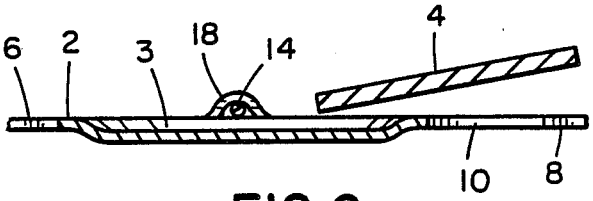

Removal of coin 4 from cup 3 is shown in FIGS. 5 and 6. In FIG. 5, coin 4 is moved to the right (manually) until the right edge of the coin emerges from cup 3. This action produces an upward flexing of pin 14, and ultimately coin 4 is dislodged completely (FIG. 6) from cup 3.

Insertion of coin 4 into cup 3 merely involves a reversal of the removal steps shown in FIGS. 5 and 6.

Hole 19 provides means for hanging disc holder 1 on a hook. It should be understood that modifications can be made to the preferred embodiment shown in the drawings without departing from the scope of the invention.

What is claimed is:

1. A holder for a disc comprising a body, a cup formed in a portion of the body with the cup having a continuous peripheral shoulder defining a mouth opening sized to receive the disc, and an elongated rod-like element that is relatively narrow in cross-section compared to the length of the element mounted on the body and extending completely across the mouth opening of the cup to retain a disc that may be seated within the cup when the disc is slipped under the elongated rod-like element and between a portion of the mouth opening defined by that element and part of the peripheral shoulder.

2. The combination of claim 1 including a disc adapted to be seated within said cup, and wherein the cup has a shallow depth approximately equal to the thickness of the disc.

3. The combination of claim 2 in which the disc is a coin.

4. The combination of claim 1 in which the rod-like element is a flexible rod which approximately bisects the mouth of the cup.

5. The combination of claim 1 including a circular disc adapted to be seated within said cup, and the mouth of the cup being of a corresponding circular shape.

6. The combination of claim 1 in which the body is a generally flat, sheet-like, metallic material and of a size so as to be manually handled and pocketed.

7. The combination of claim 5 including a disc having a circular shape adapted to be seated within said cup, and in which the cup has a shallow depth approximately equal to the thickness of the disc.

8. The combination of claim 7 in which the rod-like element is fabricated from a metallic material that is capable of lateral flexing.

9. The combination of claim 8 in which the rod-like element approximately bisects the mouth of the cup.

* * * * *